US009783989B2

(12) United States Patent
Elder

(10) Patent No.: US 9,783,989 B2
(45) Date of Patent: Oct. 10, 2017

(54) ARTICULATED DOWNSPOUT EXTENSION APPARATUS

(71) Applicant: Brian Elder, Johnson Creek, WI (US)

(72) Inventor: Brian Elder, Johnson Creek, WI (US)

( * ) Notice: Subject to any disclaimer, the term of this patent is extended or adjusted under 35 U.S.C. 154(b) by 162 days.

(21) Appl. No.: 14/956,043

(22) Filed: Dec. 1, 2015

(65) Prior Publication Data

US 2017/0152662 A1 Jun. 1, 2017

(51) Int. Cl.
*E04D 13/08* (2006.01)

(52) U.S. Cl.
CPC ..... *E04D 13/08* (2013.01); *E04D 2013/0813* (2013.01); *E04D 2013/0833* (2013.01); *E04D 2013/0846* (2013.01)

(58) Field of Classification Search
CPC ..... F16L 27/0857; E04D 13/08
USPC ..... 285/181, 182, 223, 185
See application file for complete search history.

(56) References Cited

U.S. PATENT DOCUMENTS 1,946,760 A * 2/1934 Rhine ..... B65G 11/186 285/182
2,975,805 A * 3/1961 Horn ..... F16L 27/0849 137/615
3,063,741 A * 11/1962 Bockerman ..... F16L 27/0849 285/283
3,911,954 A * 10/1975 Johnson ..... F16L 27/0849 285/283
5,328,209 A * 7/1994 Cromwell ..... F16L 27/02 285/283
5,358,006 A 10/1994 Sweers
5,435,051 A * 7/1995 Cheremshynski ..... E04D 13/08 285/184
5,522,427 A * 6/1996 Johnson ..... E04D 13/08 52/16
5,658,092 A 8/1997 Sweers
5,862,632 A 1/1999 Zima
6,647,670 B1 * 11/2003 Dran ..... E04D 13/08 52/16
8,695,200 B2 * 4/2014 Rakowicz ..... F16L 27/04 29/450
2012/0285567 A1 * 11/2012 Kessler ..... E04D 13/08 137/615

* cited by examiner

*Primary Examiner* — David E Bochna
(74) *Attorney, Agent, or Firm* — Ryan Kromholz & Manion, S.C.

(57) ABSTRACT

An extension apparatus for rainwater downspouts comprising a multi-piece, articulated extension device that is attachable to the lowermost portion of a rainwater downspout. The apparatus includes a pivotable joint for articulate movement around the joint. The apparatus further includes elastic members on the apparatus side panels to return the apparatus to an original, resting position after articulation.

7 Claims, 4 Drawing Sheets

ARTICULATED DOWNSPOUT EXTENSION APPARATUS

BACKGROUND OF THE INVENTION

The present invention relates to an extension apparatus for rainwater downspouts. More specifically, the present invention relates to a multi-piece, articulated extension apparatus that is attachable to the lowermost portion of an existing rainwater downspout.

Typical building construction may include a gutter and downspout system to collect rainwater and divert it away from the building. A downspout extension may be attached to the downspout to ensure the collected rainwater does not accumulate too close to the building and to direct it a distance away from the building. A fixed, one-piece extension may solve the problem of water accumulation, but it may also present other problems. For example, mowing the lawn is made more difficult when for example, the extension must be moved each time the adjacent lawn is to be mowed. The mower must stop to remove the extension and after mowing, must revisit the downspout to reattach the extension. This procedure takes time and is inconvenient.

SUMMARY OF THE INVENTION

The present invention provides an improved extension apparatus for rainwater downspouts that overcomes the previously described problems with typical fixed extensions. The extension apparatus comprises a multi-piece, articulated device that is attachable to the lowermost portion of an existing rainwater downspout. The apparatus includes a plurality of downspout extension members of varying lengths wherein at least two of the extension members are joined at a pivotable joint. The articulated extension apparatus is movable about the pivotable joint from an extended, in use position, to a displaced position. The apparatus is moved to the displaced position when lateral pressure is applied to an extension member, as by a lawnmower for example, and the extension member rotates on the pivotable joint. The apparatus is further configured to return the displaced extension member to the extended, in use position when lateral pressure terminates.

The extension members of the disclosed apparatus further include side panels. The extension members are connected at each side panel by elastic members. While an extension member pivots laterally about the pivotable joint in response to displacement caused by outside stimuli such as a lawnmower during lawn maintenance, when the stimuli ceases, the elastic members cause the extension member to automatically pivot and return to the extended, in use position.

DESCRIPTION OF THE PREFERRED EMBODIMENT

Figure 1:
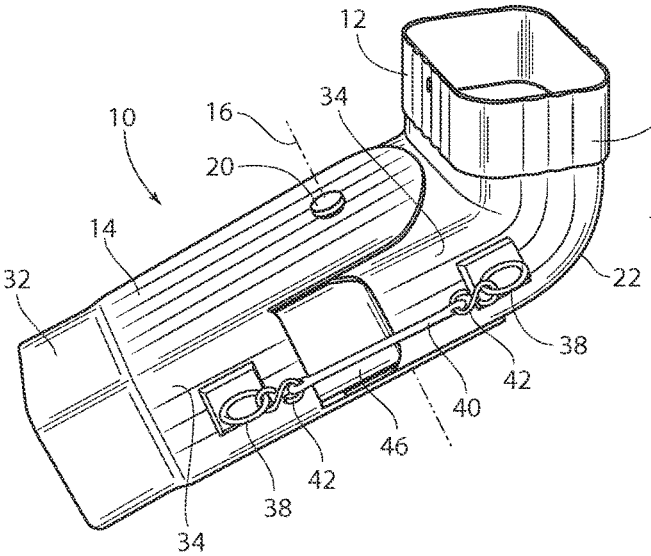
FIG. 1 is a perspective view of the apparatus according to the present invention.
Figure 2:
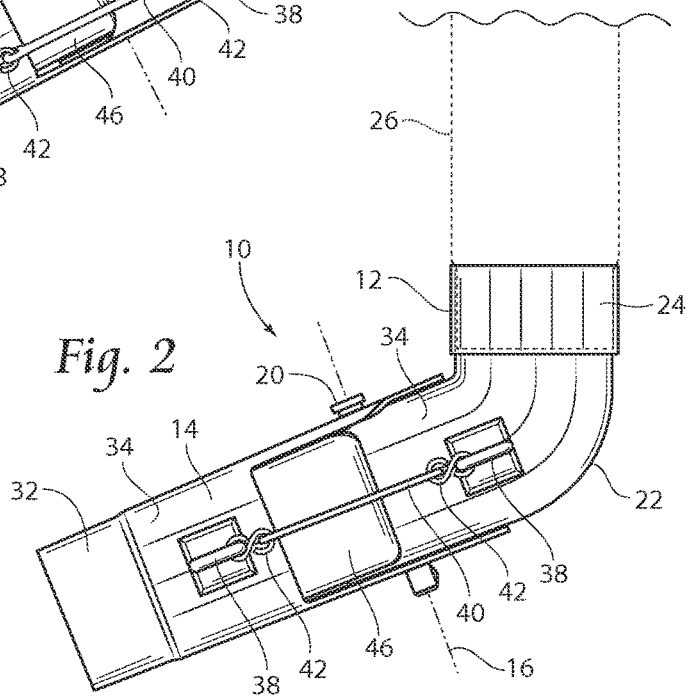
FIG. 2 is a side view of the apparatus shown in FIG. 1.
Figure 3:
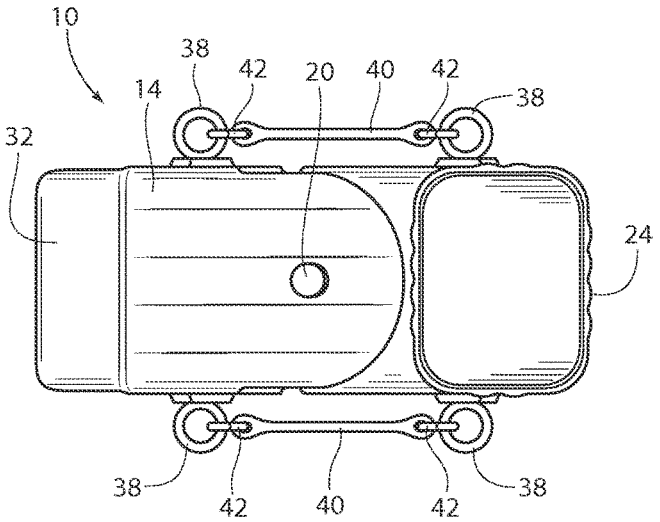
FIG. 3 is a top view of the apparatus shown in FIGS. 1 and 2.

Although the disclosure hereof is detailed, and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

With attention to the Figures, an articulated extension apparatus 10 according to the present invention may be seen. As viewed particularly in FIGS. 1-4, the apparatus 10 preferably includes at least a first extension member 12 and a second extension member 14. The first and second extension members 12, 14 are pivotally connected at a pivot point 16. The pivot, point 16 includes a pivot aperture 18A in the first extension member 12, a pivot aperture 18B in the second extension member 14 and pivot hardware, seen as a pull pin 20 in these views. As may be further seen, the first member 12 may include an elbow 22 having a first elbow end 24 configured for mating attachment with the lowermost portion of a downspout 26, although it is within the scope of the present invention to provide a first extension member 12 that has a linear configuration and no elbow (not shown). The first member 12 further includes a second end 28 which is adapted for attachment to the second extension member 14 and includes the pivot aperture 18A. The second extension member 14 includes a first end 30 and a second end 32, with the first end 30 being configured for mating attachment to the first member 12 and including a pivot aperture 18B. The second end 32 of the second extension member 14 is configured for optional mating attachment with another extension member (not shown), if desired. Extension members 12, 14 for use with the present apparatus 10 may be of varying lengths, and may be composed of a polymer such as PVC, metal, or other suitable material.

As further seen in FIGS. 1-5, each of the extension members 12, 14 includes opposed side panels 34 each having a side panel 34 outer surface 36. Each side panel 34 outer surface 36 preferably includes at least one anchor device, such as the eye rings 38 shown, although other suitable devices may be used. An elastic member 39, such as the elastic cord 40 and S-connectors 42 arrangement shown, may be used to further connect the first and second extension members 12, 14. As illustrated, the elastic member 39 includes opposed elastic member ends 44, with each end 44 being attached to a corresponding anchor device 38 on one of the extension members 12, 14. In use, the elastic member 39 supports the apparatus 10 in the fully extended position (see FIG. 7B), while providing sufficient elasticity to allow the second extension member 14 to articulate at the pivot point 16 (see FIG. 7A) when lateral pressure is applied. The elastic member 39 further draws the second extension member 14 back to the fully extended position once lateral pressure ceases, as will be discussed.

Figure 4:
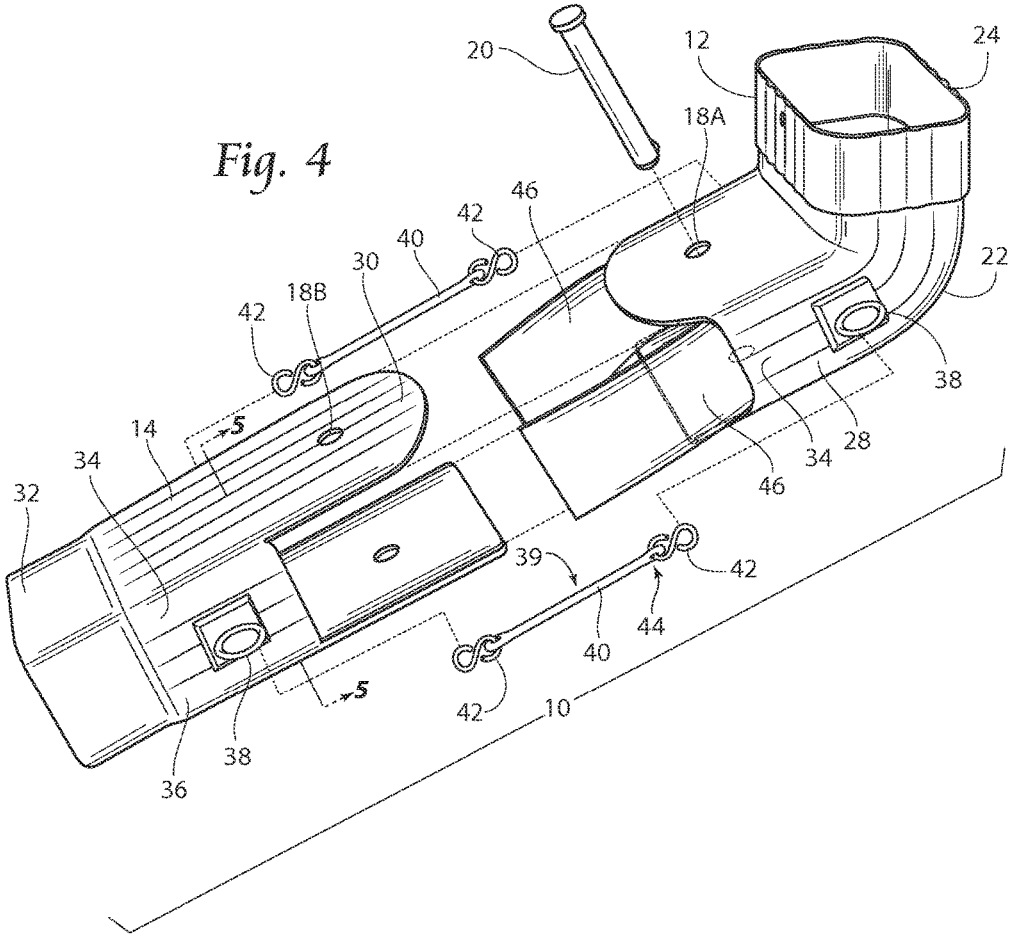
FIG. 4 is an exploded view of the apparatus shown in FIGS. 1-3.
Figure 5:
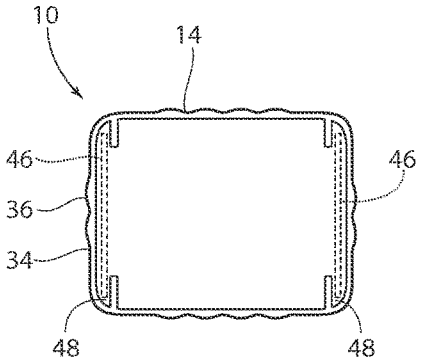
FIG. 5 is a cross sectional view of the apparatus shown in FIG. 4 and taken along lines 5-5 thereof.
Figure 6:
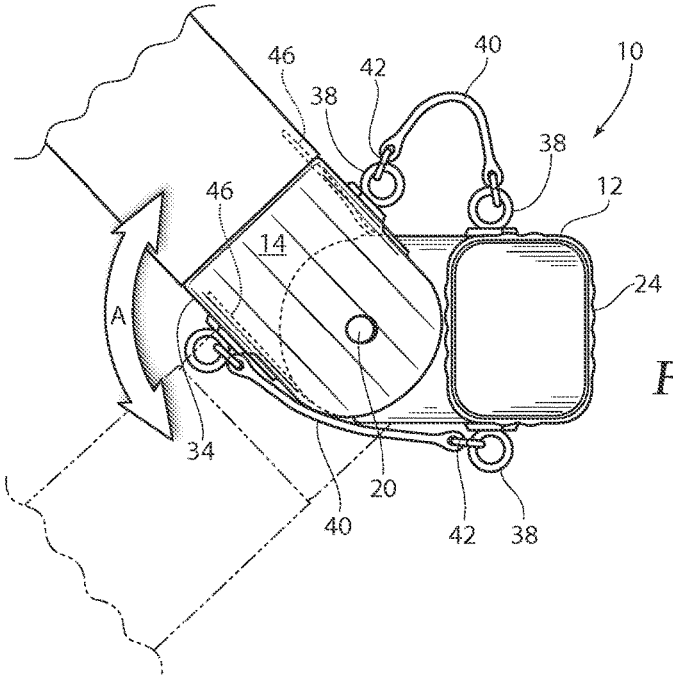
FIG. 6 is a top view, similar to that of FIG. 3, but showing pivoting motion of the apparatus.

With particular attention to the views of FIGS. 4 and 5, it may be seen that the first extension member 12 second end 28 may include a pair of opposed flexible flaps 46. The flaps 46 are configured to be received within corresponding slots 48 in the second extension member 14 (see FIG. 5) and are preferably made of a resilient, flexible material, such as a polymer or the like. The flaps 46 interact with the second extension member 14 in the slots 48 to slidingly connect the first and second extension members 12, 14, and to flex when the apparatus 10 is articulated about the pivot point 16. As is shown in FIG. 6, the pivoting action of the second extension member 14 in the direction of arrow A flexes the flaps 46 to thereby allow the apparatus 10 to articulate at the pivot point 16. The flaps 46 further cover any gaps in the side panel 34.

Figure 7A:
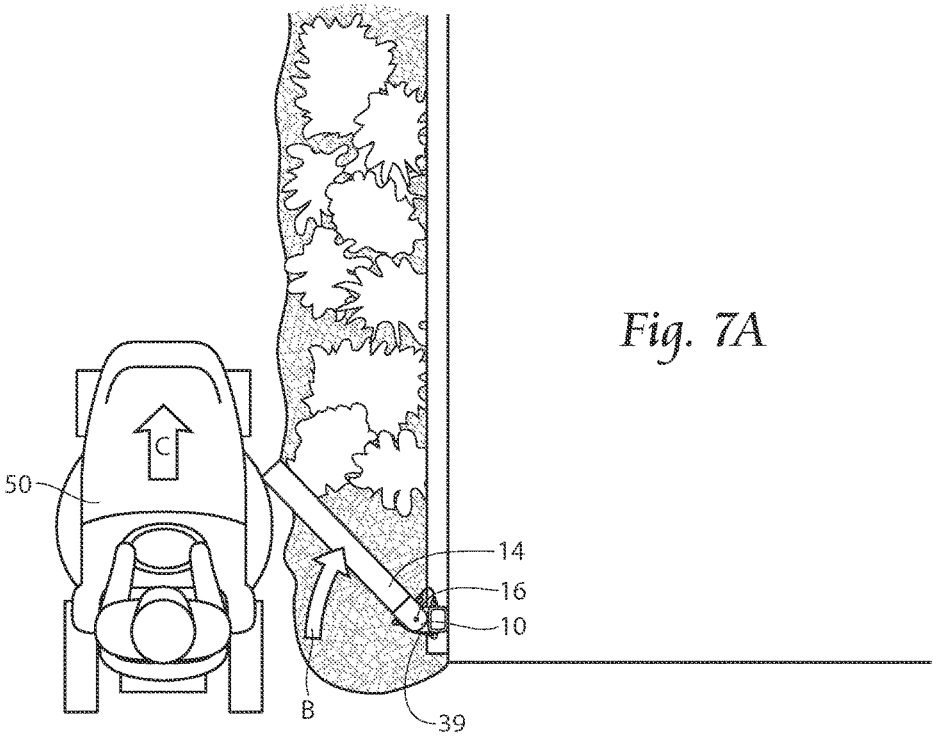
FIGS. 7A and 7B are top views showing use of the apparatus.
Figure 7B:
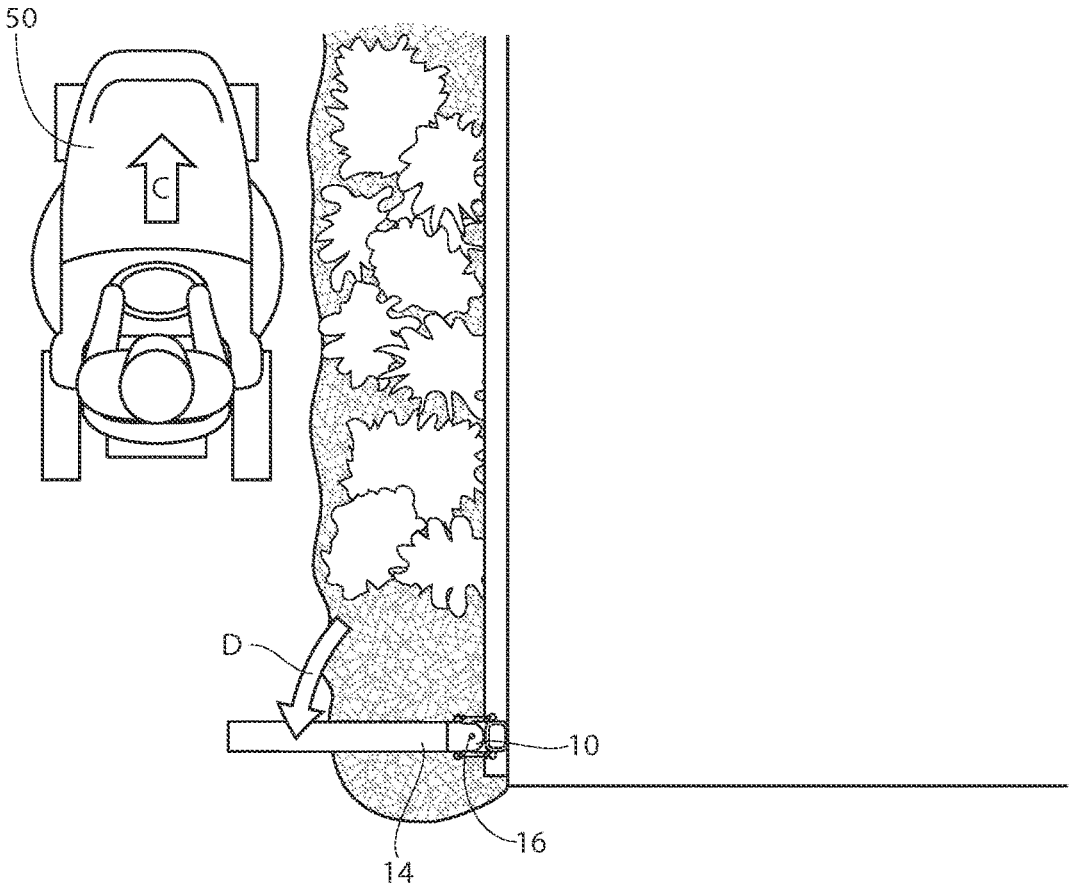

FIGS. 7A and 7B illustrate a method of use for the articulated extension apparatus 10 according to the present invention. As may be viewed, the second extension member 14 is moved in the direction of arrow B as a lawnmower 50 or other ground maintenance device moves in the direction of arrow C adjacent the apparatus 10. The lawnmower 50 or other ground maintenance device contacts and applies lateral pressure on the second extension member 14. The lateral pressure of the lawnmower 50 in contact with the apparatus 10 overcomes the bias of the elastic member 39 and the apparatus 10 pivots as the second extension member 14 moves about the pivot point 16 in the direction of arrow B. The pivoting movement allows the lawnmower 50 to pass the apparatus 10 without the need for the user to stop, disassemble, or otherwise manually reposition the device 10. As the lawnmower 50 continues in the direction of arrow C, and as shown in FIG. 7B, lateral pressure against the second extension member 14 ceases, the bias of the elastic member 39 moves the second extension member 14 in the direction of arrow D, and the apparatus 10 resumes its original position.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. An extension apparatus comprising:

a first extension member and a second extension member;

said first extension member having a first end and a second end, said second end being pivotally attached to a first end of said second extension member at a pivot point;

said pivot point having a first pivot aperture in said first extension member, a second pivot aperture in said second extension member, and a pivot pin extending through said first and second pivot apertures;

said first extension member and said second extension member each having opposed side panels; and an elastic member, said elastic member having a first elastic end and a second elastic end wherein said first elastic end is connected to a side panel of said first extension member and said second elastic end is connected to a corresponding side panel of said second extension member.

2. The extension apparatus of claim 1 wherein said first member further includes an elbow having a first elbow end, said first elbow end being configured for mating attachment with a lowermost portion of a downspout.

3. The extension apparatus of claim 2 wherein said second extension member includes a second end configured for mating attachment with a third extension member.

4. The extension apparatus of claim 2 wherein said second end of said first extension member includes at least one flexible flap, and wherein said first end of said second extension member includes a slot, said at least one flexible flap being configured to be received within said slot.

5. A method of using an articulated extension apparatus including the steps of:

providing a first extension member and a second extension member;

providing said first extension member with a first end and a second end;

providing a pivot point, said pivot point having a first pivot aperture in said first extension member, a second pivot aperture in said second extension member, and a pivot pin extending through said first and second pivot apertures;

pivotally attaching said second end of said first extension member to a first end of said second extension member at said pivot point;

providing each of said first extension member and said second extension member with opposed side panels;

providing an elastic member having a first elastic end and a second elastic end;

anchoring said first elastic end to a side panel of said first extension member;

anchoring said second elastic end to a corresponding side panel of said second extension member;

positioning said first extension member and said second extension member in a first position;

pivoting said second extension member about said pivot point to a second position; and pivoting said second extension member about said pivot point to said first position.

6. The method of claim 5 further including the step of providing said first extension member with an elbow.

7. The method of claim 6 further including the steps of providing said second end of said first extension member with at least one flexible flap;

providing said first end of said second extension member with a slot; and positioning said at least one flexible flap within said slot.

* * * * *